US005697796A

United States Patent [19]

Harji et al.

[11] Patent Number: 5,697,796

[45] Date of Patent: Dec. 16, 1997

[54] CONTACT SLEEVE

[75] Inventors: Haiderali Harji, Schwalbach; Franz Gutmann, Frankfurt; Werner Eckhardt, Schwalbach, all of Germany

[73] Assignee: VDO Adolf Schindling AG, Frankfurt, Germany

[21] Appl. No.: 605,654

[22] Filed: Feb. 22, 1996

Related U.S. Application Data

[63] Continuation of Ser. No. 149,678, Nov. 9, 1993, abandoned.

[30] Foreign Application Priority Data

Dec. 2, 1992 [DE] Germany ..... 42 40 452.5

[51] Int. Cl.[6] ..... H01R 13/73; H01R 9/09

[52] U.S. Cl. ..... 439/76.1; 439/79; 439/573

[58] Field of Search ..... 439/76.1, 79, 80, 439/325, 328, 552, 564, 573, 603, 844, 843, 847, 862

[56] References Cited

U.S. PATENT DOCUMENTS

| | | | |
|---|---|---|---|
| 2,687,862 | 8/1954 | Crowther | 439/552 |
| 3,989,333 | 11/1976 | Cauldwell | 439/76 |
| 4,802,860 | 2/1989 | Kikuta | 439/79 |
| 4,842,552 | 6/1989 | Frantz | 439/573 |
| 5,108,296 | 4/1992 | Takano | 439/573 |

FOREIGN PATENT DOCUMENTS

| | | |
|---|---|---|
| 1137263 | 9/1962 | Germany . |
| 8613605 | 7/1988 | Germany . |
| 4039625 | 6/1992 | Germany . |
| 2177553 | 1/1987 | United Kingdom . |

*Primary Examiner*—Kurt Rowan
*Attorney, Agent, or Firm*—Martin A. Farber

[57] ABSTRACT

A contact sleeve is inserted in a recess (6) in a support part (2) of a measurement movement, such as a moving magnet measurement instrument, to provide connection in electrically conductive manner to the measurement movement. For this purpose, a contact screw (12) can be screwed into the recess, a circuit board (11) being pressed by it against an end mouth region of the recess (6). A conductive-track region (17) of the circuit board (11) can in this connection be connected in electrically conductive manner to the contact sleeve (7). The contact sleeve (7) on its end facing the circuit board (11), has an approximately radially outwardly extending flange-like widening which extends into the end mouth region of the recess (6) between support part (2) and the circuit board (11) which can be pressed thereon.

29 Claims, 4 Drawing Sheets

FIG.1
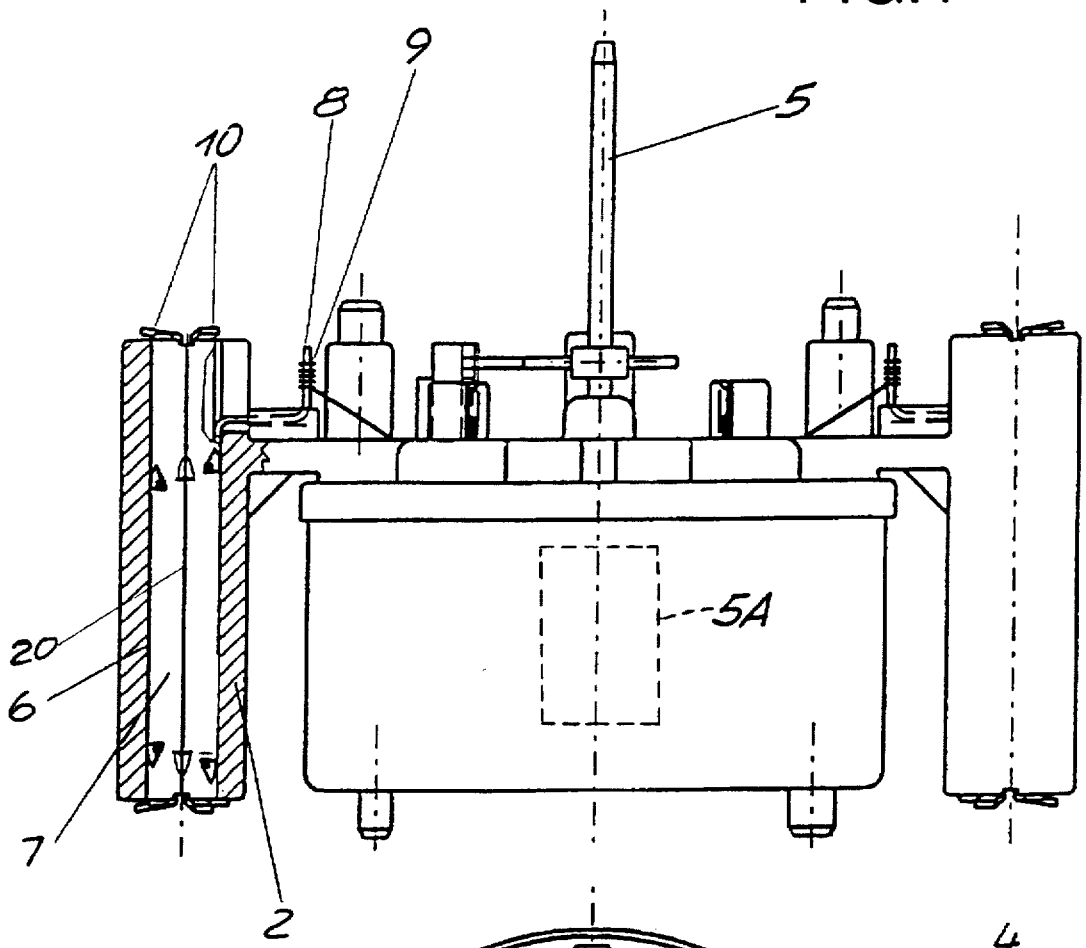
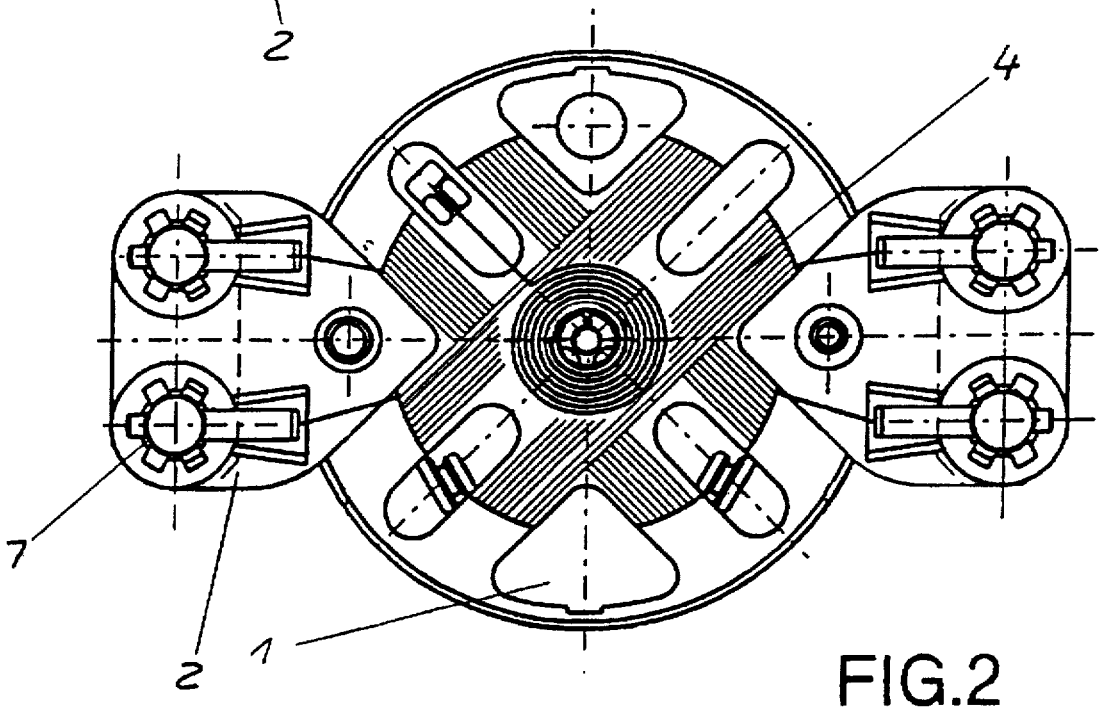
FIG.2

CONTACT SLEEVE

RELATED APPLICATION

This application is a continuation of our application Ser. No. 08/149,678 filed Nov. 9, 1993 now abandoned.

FIELD AND BACKGROUND OF THE INVENTION

The present invention relates to a contact sleeve for insertion into a recess in a housing or support part of an electric measurement movement, such as a meter for measurement of electric current, to provide for electrical connection to the movement. A contact or fastening screw is employed with the contact sleeve for pressing a circuit board against an end-side mouth region of the recess. The screw is screwed into the contact sleeve within the recess whereby a conductive-track region of the circuit board can be connected in electrically conductive manner to the contact sleeve.

With such a contact sleeve, it is known to provide an electrical contacting of a conductive-track region of a circuit board to the contact sleeve by means of the contact screw. In this connection, the head of the contact screw lies on the conductive track on the side of the circuit board facing away from the housing part.

SUMMARY OF THE INVENTION

It is an object of the invention to create a contact sleeve of the aforementioned type which ensures a highly reliable contact and which can be used, without change, for the most diverse arrangements of the region of the conductive track on the circuit board.

According to the invention, the contact sleeve (7, 7') is provided on its end facing the circuit board (11, 11', 11") with a flange-like widening which extends approximately radially outward and extends into the end mouth region of the recess (6, 6') between the housing or support part (2) and the circuit board (11, 11', 11") which can be pressed thereon.

This development makes it possible to arrange the region of the conductive track on the side facing away from the housing part, the screw serving as both contact screw and fastening screw.

In accordance with another possibility, the conductive-track region is arranged on the side facing the housing part. In this case, the flange-like widening lies with a large surface against the conductive-track region and thus assures the contact. In this case, the screw has solely the function of fastening the circuit board to the housing part and of pressing the conductive-track region against the flange-like widening.

However, the flange-like widening does not merely serve for the contacting but, at the same time, it becomes a mounting stop for the insertion of the contact sleeve into the recess in the housing part.

Furthermore, the flange-like widening acts to a certain extent as a spring arm and, upon the tightening of the screw, it is clamped between the housing part and the circuit board, as a result of which both the reliability of the contact is increased and manufacturing tolerances can be compensated for.

The contact sleeve is particularly simple to manufacture if the flange-like widening is formed of one or more radially outwardly directed tabs (10). In this way, the contact sleeve can consist of a sheet-metal part which is bent so as to from a sleeve and within the end region of which axial cuts which form tabs are present, the cuts permitting the tabs to be bent radially outward. This development also improves the spring behavior and thus the reliability of contact of the widening.

The contact screw (12) can preferably be pressed via its screw head (15), which is widened radially as compared with the screw shank (14), against the conductive-track region (17) arranged on the side of the circuit board (11, 11') facing away from the housing or support part (2).

In order to increase the dependability of the contact and protect the conductive-track region against abrasion, a contact washer (18) can be arranged between screw head (15) and conductive-track region (17), the reliability of contact being further increased if a spring washer (19) is arranged between screw head (15) and contact washer (18).

If the recess (6, 6') passes all the way through and the contact sleeve (7, 7') is so developed as to extend through the entire recess (6, 6'), flange-like widenings extending in both mouth regions of the recess (6, 6') are provided. Then the two variants of the circuit-board contactings can be applied at each end of the recess. This has the result that a single development of a contact sleeve can be used for the most diverse constructions of the circuit board so that cost-favorable manufacture and storage of the contact sleeve is possible.

If the flange-like widening extends radially outward at an acute angle to the end mouth region of the housing or support part, the spring action of the flange-like widening and thus the reliability of the contact are further increased.

Recess (6, 6') and contact sleeve (7, 7') may have a circular cross section or else a polygonal and particularly a square cross section. In this connection, a polygonal cross section has the advantage that it results at the same time in a form-locked securing of the screw against rotation around the longitudinal axis of the contact sleeve in the recess.

If the contact sleeve (7, 7') has a lengthwise slit (20) passing through it, spreading and thus a position-securing firm pressing of the contact sleeve in the recess can be obtained in simple manner by the screwing-in of the contact or fastening screw.

In the case of a contact sleeve of polygonal cross section, the longitudinal slit (20) preferably extends along a corner of the contact sleeve (7').

For the screwing of the screw into the contact sleeve, the contact or fastening screw (12) can in one embodiment be adapted to be screwed in self-cutting or thread-producing manner into the contact sleeve (7').

This is particularly readily possible when the inner wall of the contact sleeve (7') and/or the surface of the contact flange facing the conductive track (17) is provided with an easily plastically deformable layer of good conductivity, such as, for instance, a layer of tin. This layer is preferably formed of a material which, in addition, has a low contact resistance and is non-oxidizing.

By the easy plastic deformability, both in the region of the screw shank and in the region of the flange-like widening, an adaptation of the shape of the adjoining parts is obtained and thus a high reliability of contact.

Another embodiment for the screwability of the screw consists therein that at least one radially inwardly directed projection (23) for engagement in the thread of the contact or fastening screw (12) is developed on the inner wall of the contact sleeve (7). In order to maintain the certainty of contact, a plurality of projections (23) are preferably developed, spaced vertically and laterally apart from each other corresponding to the pitch of the thread of the contact or fastening screw (12).

In order to secure the contact sleeve against turning in the recess around the longitudinal axis and/or against axial displacement, the contact sleeve (7, 7') can be inserted with force-locking, friction-locking or form-locking into the recess (6, 6'). For this purpose, the contact sleeve (7') can be provided with a roughening, formed, for instance, by knurling on its outer wall surface.

Another possibility resides in the contact sleeve (7') having a projection which protrudes from its outer wall surface.

The contact sleeve (7) can also have a spring arm (21) which protrudes from its outer wall surface.

Furthermore, the contact sleeve can be provided on its outer wall surface with an opening into which a corresponding extension which protrudes from the inner wall of the recess can engage.

For the connection of the measurement movement, the contact sleeve (7, 7') can have a contact lug (8). If, in this connection, the contact lug (8) is formed by bending a partially stamped-out section of the wall out of the outer surface of the contact sleeve (7), then no additional material is required for the contact lug.

BRIEF DESCRIPTION OF THE DRAWINGS

With the above and other objects and advantages in view, the present invention will become more clearly understood in connection with the detailed description of preferred embodiments, when considered with the accompanying drawing, of which:

FIG. 1 is a side view of a measuring instrument, in a partial section;

FIG. 2 is a top view of the measurement instrument of FIG. 1;

DETAILED DESCRIPTION OF THE PREFERRED EMBODIMENTS

Figure 3:
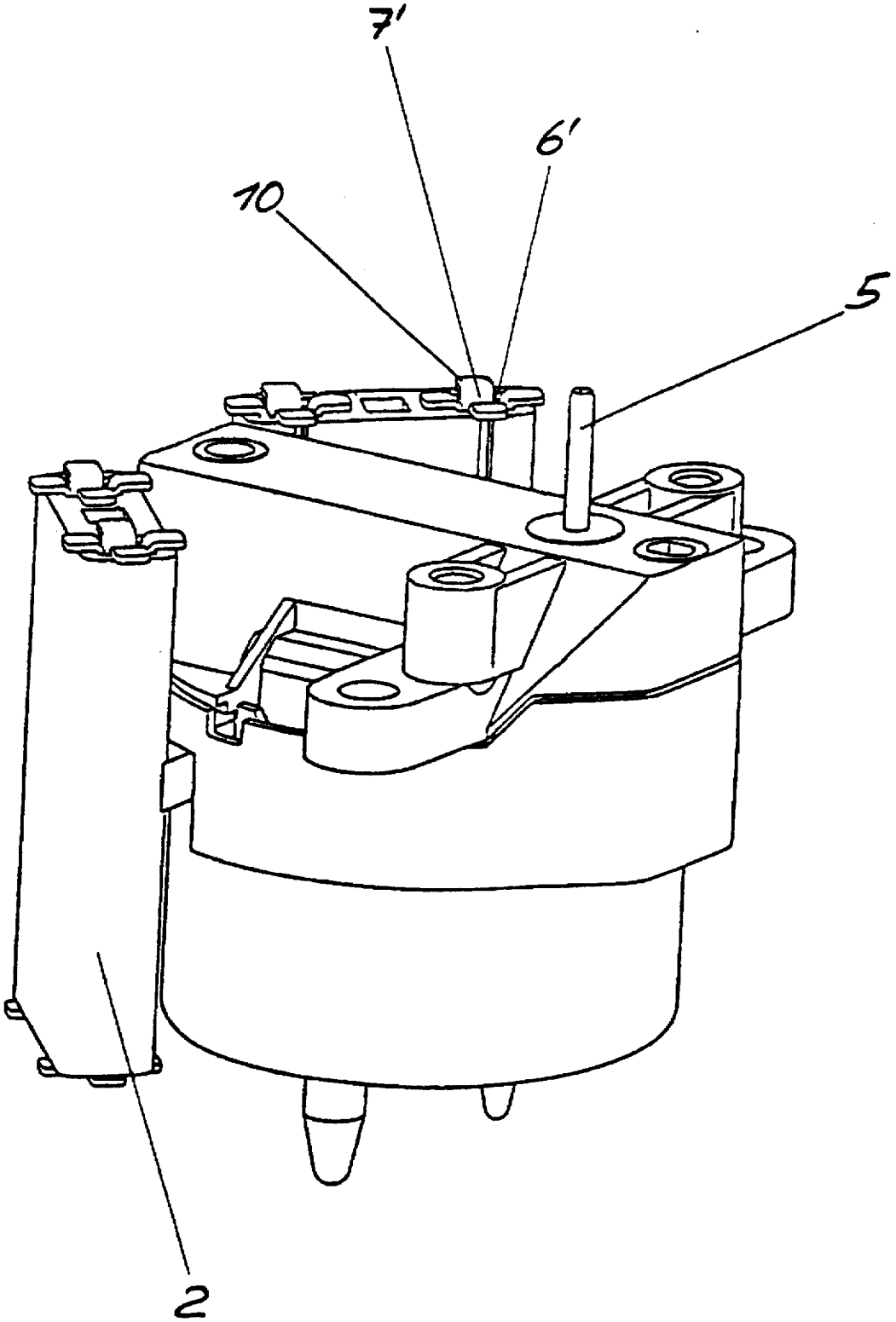
FIG. 3 is a perspective view of a second measuring instrument.

The measuring instrument shown in FIGS. 1, 2 and 3 has a measurement movement including a winding support 1 bearing windings 4 and having support arms 2 arranged laterally thereto for the attachment of a circuit board as well as possibly also for attaching the measuring instrument to a support.

Within the windings 4, and disposed along a central axis of the windings 4, is a permanent magnet 5A (indicated in phantom view) which provides a torque which is a function of current passing through the windings. The permanent magnet is rotatably mounted to a pointer shaft 5 extending from it to outside the windings. In the support arms 2, continuous recesses 6 and 6' are developed axially to the pointer shaft 5, into which recesses, in accordance with the invention, contact sleeves 7 and 7' respectively are inserted. The contact sleeves 7 and 7' have laterally protruding contact lugs 8 to which the ends of the windings 9 are connected.

At their two ends, the contact sleeves 7 and 7' are provided with tabs 10 which are directed in flange-like manner toward the outside and extend approximately radially along the end region of the mouth of the recesses 6 and 6'.

Figure 8:
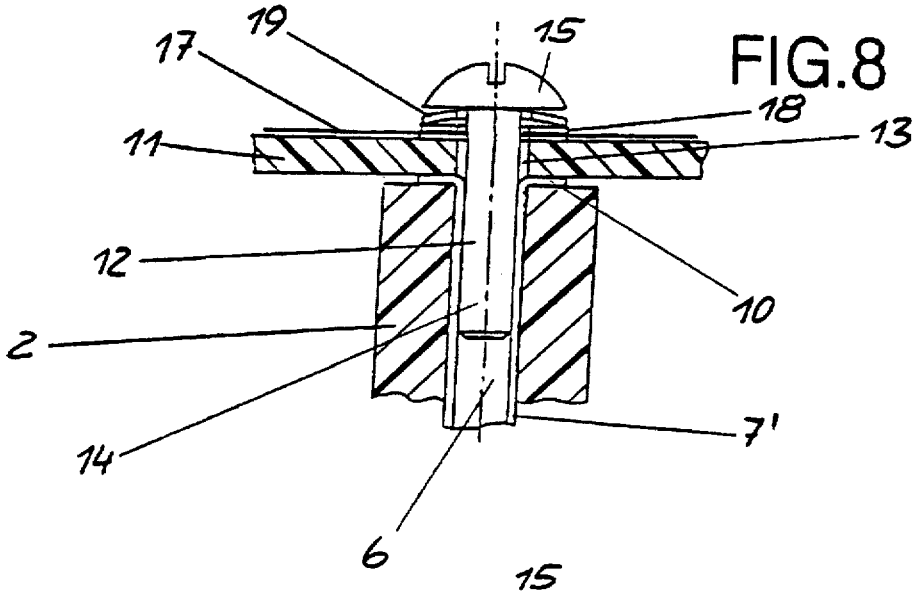
FIG. 8 is a sectional view of a first embodiment of the contacting of a contact sleeve with a circuit board.
Figure 9:
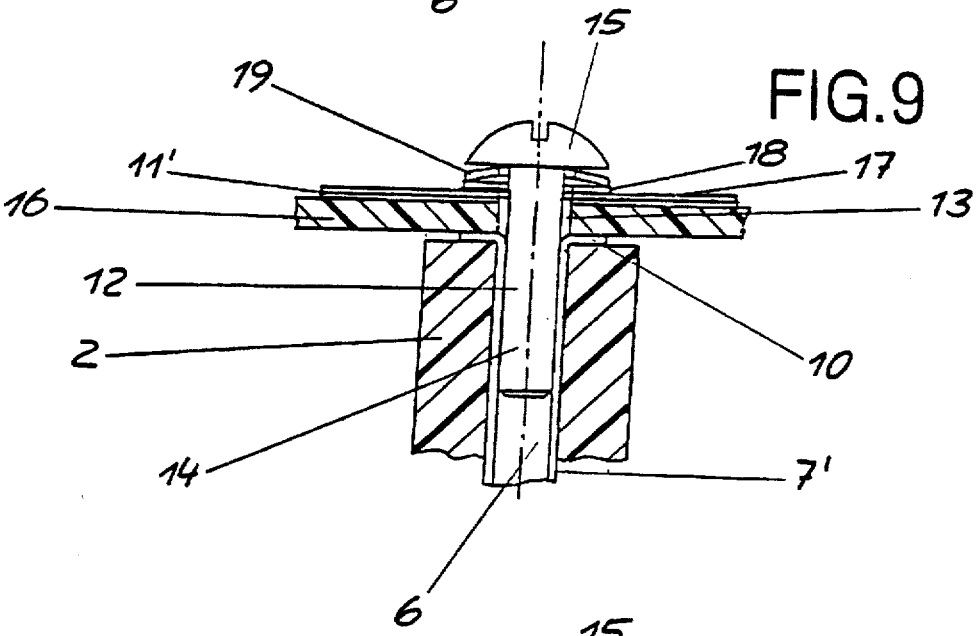
FIG. 9 is a sectional view of a second embodiment of the contacting of a contact sleeve with a circuit board.
Figure 10:
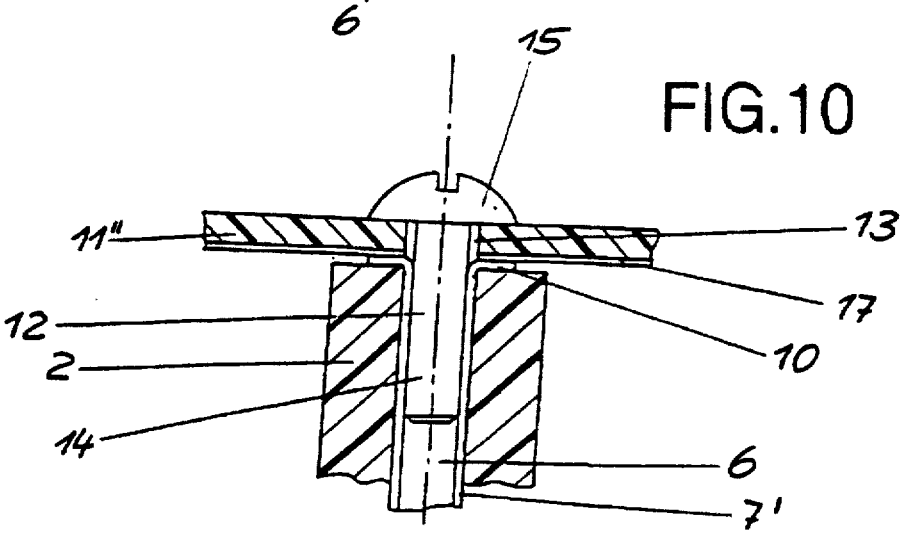
FIG. 10 is a sectional view of a third embodiment of the contacting of a contact sleeve with a circuit board.

As can be noted from FIGS. 8 to 10, a circuit board 11, 11' or 11" is placed on the end of the support arms 2 and fastened by a fastening screw 12. This fastening screw 12 passes through a recess 13 in the circuit board 11, 11', or 11", respectively, and its shank 14 is screwed into the contact sleeve 7'. In this connection, the fastening screw 12 is a self-cutting screw which, by its thread, cuts into the inner wall of the contact sleeve 7'. By its screw head 15, the fastening screw 12 presses the circuit board 11, 11' or 11", respectively, via the tabs 10 of the contact sleeves 7' which extend between support arm 2 and circuit board 11, 11' or 11", respectively, onto the end region of the mouth of the support arm 2 surrounding the recess 6.

In FIG. 9 the circuit board 11' is a flexible circuit board between which and the tabs 10 a support plate 16 is furthermore arranged.

In FIGS. 8 and 9, the copper-covered conductive-track region 17 of the circuit boards 11 and 11' is arranged on the side facing the screw head 15. The screw head 15, in this connection, lies on the conductive-track region 17 via a contact washer 18 lying on the conductive-track region 17 and a spring washer 19. By means of these washers 18 and 19, as well as the fastening screw 12 which consists of elastically conductive material and serves at the same time as contact screw, the conductive-track region 17 is conductively connected to the contact sleeve 7.

In FIG. 10, the conductive-track region 17 is arranged on the side of the circuit board 11" facing away from the screw head and lies directly on the tabs 10 of the contact sleeve 7'. The electrically conductive connection from the conductive-track region to the contact sleeve 7' is effected here directly.

FIGS. 4 and 5, and 6 and 7 show two embodiments of the contact sleeves 7 and 7'.

Figure 4:
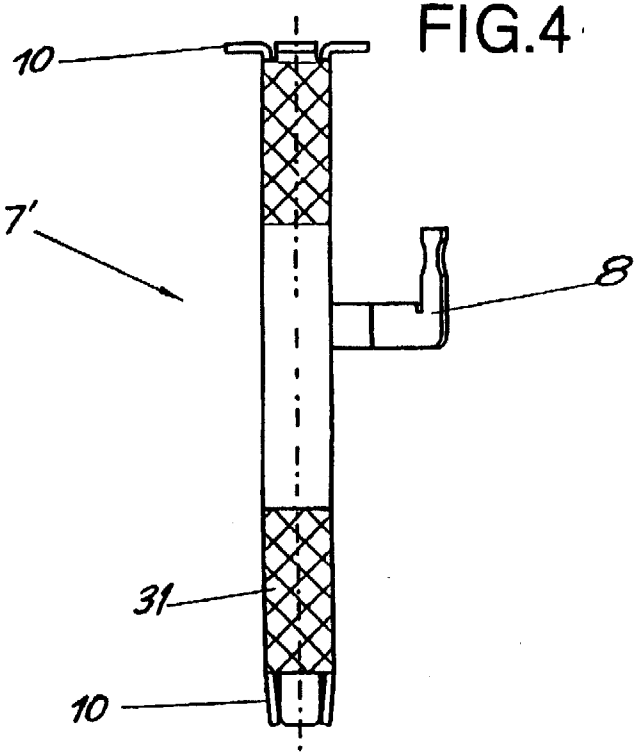
FIG. 4 is a side view of first embodiment of a contact sleeve.
Figure 5:
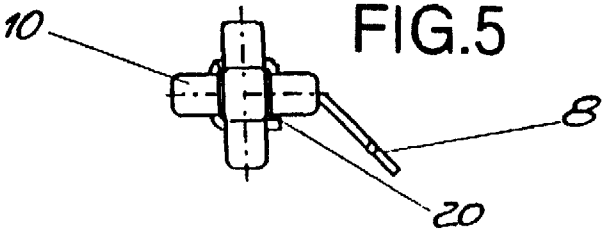
FIG. 5 is a top view of the contact sleeve of FIG. 4.

The contact sleeve 7' shown in FIGS. 4 and 5, which is intended for the measuring instrument in accordance with FIG. 3 and the embodiments of FIGS. 8 to 10, has a square cross section and a lengthwise slit 20 along its one corner. This contact sleeve 7' is intended for insertion in a recess 6' of corresponding square cross section. In this connection, the contact sleeve 7' is introduced in the condition shown with the tabs 10 at the lower end directed axially into the recess 6 and these lower tabs 10 are then bent over at approximately a right angle corresponding to the upper tabs. Thus, both the tabs 10 formed on the upper end of the contact sleeve and the tabs formed on its lower end form stops which rest against the surfaces of the support arm which extend approximately radially along the end mouth regions on both sides of the recess 6'.

For the further securing of the contact sleeve 7' in the recess 6', the outer wall surface of the contact sleeve 7' is provided in its two end regions with a knurling 31 so that the contact sleeve 7', when the fastening screw 12 is screwed in and expands the contact sleeve 7', rests with force-lock and friction-lock against the wall of the recess 6'. The fastening screw 12 is in this connection screwed in self-cutting manner into the contact sleeve 7'.

Figure 6:
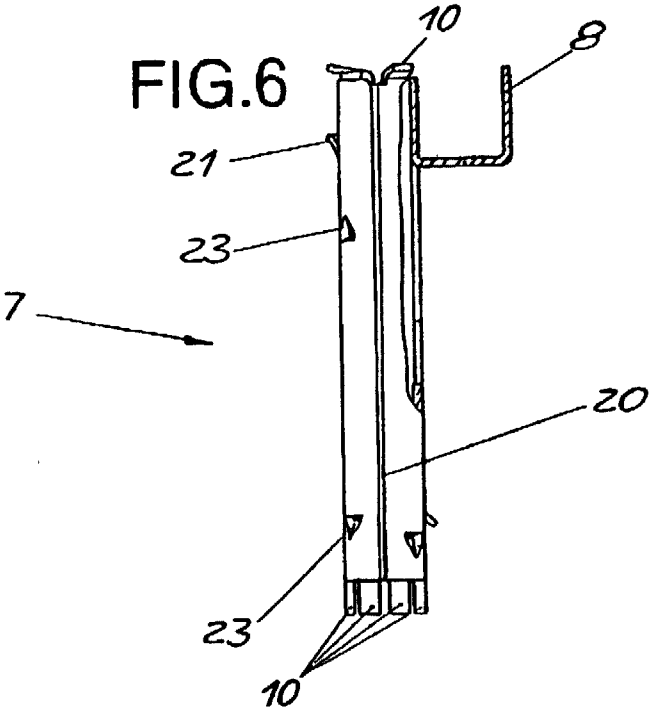
FIG. 6 is a side view of a second embodiment of a contact sleeve.
Figure 7:
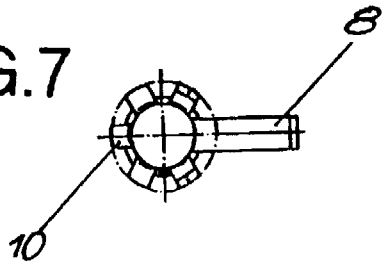
FIG. 7 is a top view of the contact sleeve of FIG. 6.

The contact sleeve 7 shown in FIGS. 6 and 7, which is intended for the measuring instrument according to FIGS. 1 and 2, has, corresponding to the recess 6 associated with it, a round cross section with a longitudinal slit 20. The inserting and axial securing of the contact sleeve 7 by the bending over the tabs 10 is effected in the same manner as in the embodiment shown in FIGS. 4 and 5. The additional securing of the contact sleeve 7 in the recess 6 is effected by spring arms 21, produced by cutting-out, which protrude from the outer wall surface of the contact sleeve 7, the free ends of which arms can dig into the wall of the recess 6.

Both embodiments of the contact sleeves 7 and 7' are produced by stamping from sheet metal and have laterally protruding contact lugs 8. In this connection, in the embodiment shown in FIGS. 6 and 7, the contact lug 8 is formed by bending the partially stamped-out section of the wall out of the surface of the contact sleeve 7.

The contact sleeve 7, furthermore, has radially inwardly directed projections 23 which are produced by indentations, and are developed spaced apart vertically and laterally in accordance with the pitch of the thread of the fastening screw 12. They thereby serve as a thread into which the thread of the fastening screw 12 can be screwed. The tabs 10 of the contact sleeve 7—as can be noted in particular from FIG. 1—extend at an acute angle to the end region mouth of the support arm, so that, in assembled condition, they rest with initial spring pressure against the circuit board 11.

As shown in the embodiments, in particular, of FIGS. 1 and 2, tabs 10 are arranged on both ends of the contact sleeves 7 and 7' so that circuit boards 11, 11' or 1" can be arranged optionally on the front side or back of the measurement movement.

We claim:

1. An electrical contact sleeve for insertion into a recess in a housing or support part of a measurement movement, which sleeve is connectable in electrically conductive manner to the movement, wherein the movement further comprises a circuit board to be secured to the housing or support part by the contact sleeve;

a contact operable with said contact sleeve to urge said sleeve outward for securing said sleeve in the recess by a screwing of the contact in the recess;

wherein, upon said screwing of said contact, said circuit board is pressed by a clamping of said contact against said housing or support part at an end-side mouth region of the recess, and a conductive-track region of said circuit board is connected in electrically conductive manner to said contact sleeve;

a portion of said contact sleeve is bent approximately radially outward on an end thereof facing said circuit board to form a flange-like widening which extends approximately radially outward and extends into the mouth region of the recess between said housing or support part and said circuit board;

said flange-like widening acts as a spring element, responsive to said screwing of said contact, to provide a spring loading to said flange-like widening during said clamping of said flange-like widening between said housing or support part and said circuit board for improved reliability of contact; and the flange-like widening comprises at least one radially outwardly directed tab.

2. A contact sleeve according to claim 1, wherein said contact comprises a fastening screw.

3. A contact sleeve according to claim 2, wherein the contact screw has a screw head and shank, and is pressable via its screw head, which is widened radially as compared with the screw shank, against said conductive-track region, said conductive track region being arranged on the side of said circuit board facing away from said housing or support part.

4. A contact sleeve according to claim 3, further comprising a contact washer which is arranged between said screw head and said conductive-track region.

5. A contact sleeve according to claim 4, further comprising a spring washer which is arranged between said screw head and said contact washer.

6. A contact sleeve according to claim 1, wherein said recess passes through said support part, and said contact sleeve extends through the entire recess, said sleeve having flange-like widenings extending in both mouth regions of the recess.

7. A contact sleeve according to claim 6, wherein the flange-like widening extends radially outward at an acute angle to the end mouth region of the housing or support part.

8. A contact sleeve according to claim 1, wherein said recess and said contact sleeve have a circular cross-section.

9. A contact sleeve according to claim 1, wherein said recess and said contact sleeve have a polygonal cross-section.

10. A contact sleeve according to claim 1, wherein said recess and said contact sleeve have a square cross-section.

11. A contact sleeve according to claim 1, wherein said contact sleeve has a lengthwise slit passing through it.

12. A contact sleeve according to claim 11, wherein said longitudinal slit extends along a corner of the contact sleeve.

13. A contact sleeve according to claim 1, wherein said contact sleeve allows said contact to be screwed in self-cutting or thread-producing manner into said contact sleeve.

14. A contact sleeve according to claim 1, further comprising at least one radially inwardly directed projection disposed on an inner wall of said sleeve for engagement in a thread of said contact.

15. A contact sleeve according to claim 1, further comprising a plurality of inwardly directed projections disposed on an inner wall of said sleeve for engagement in a thread of said contact, said projections being spaced vertically and laterally apart from each other corresponding to a pitch of the thread of said contact.

16. A contact sleeve according to claim 1, wherein said contact sleeve is insertable with force-locking into said recess.

17. A contact sleeve according to claim 1, wherein said contact sleeve is insertable with friction-locking into said recess.

18. A contact sleeve according to claim 1, wherein said contact sleeve is insertable with form-locking into said recess.

19. A contact sleeve according to claim 1, wherein said contact sleeve is provided with a roughening on its outer wall surface.

20. A contact sleeve according to claim 19, wherein said roughening is a knurling.

21. A contact sleeve according to claim 1, wherein said contact sleeve has a projection which projects from its outer wall surface for engagement with said recess.

22. A contact sleeve according to claim 1, wherein said contact sleeve has a spring arm which projects from its outer wall surface for engagement with said recess.

23. A contact sleeve according to claim 1, wherein said contact sleeve has a contact lug for connection of the measurement movement.

24. A contact sleeve according to claim 23, wherein said contact lug comprises a bent partially stamped-out section on an outer surface of a wall of said contact sleeve.

25. An electrical contact sleeve for insertion into a recess in a housing or support part of a measurement movement, which sleeve is connectable in electrically conductive manner to the movement, wherein the movement further comprises a circuit board to be secured to the housing or support part by the contact sleeve;

a contact operable with said contact sleeve for securing said sleeve in the recess by a screwing of the contact in the recess;

wherein, upon said screwing of said contact, said circuit board is pressed against said housing or support part at an end-side mouth region of the recess, and a conductive-track region of said circuit board is connected in electrically conductive manner to said contact sleeve;

said contact sleeve has on an end thereof facing said circuit board a flange-like widening which extends approximately radially outward and extends into the mouth region of the recess between said housing or support part and said circuit board; and said contact sleeve has an opening on its outer wall surface for receiving an extension of said housing or support which projects from an inner wall of said recess.

26. An electrical contact sleeve for insertion into a recess in a housing or support part of a measurement movement, which sleeve is connectable in electrically conductive manner to the movement, wherein the movement further comprises a circuit board to be secured to the housing or support part by the contact sleeve;

a contact operable with said contact sleeve for securing said sleeve in the recess by a screwing of the contact in the recess;

wherein, upon said screwing of said contact, said circuit board is pressed against said housing or support part at an end-side mouth region of the recess, and a conductive-track region of said circuit board is connected in electrically conductive manner to said contact sleeve;

said contact sleeve has on an end thereof facing said circuit board a flange-like widening which extends approximately radially outward and extends into the mouth region of the recess between said housing or support part and said circuit board;

said recess passes through said support part, and said contact sleeve extends through the entire recess, said sleeve having flange-like widenings extending in both mouth regions of the recess; and an inner wall of said contact sleeve and/or a surface of said contact flange facing said conductive track has a plastically deformable layer of good conductivity.

27. An electrical contact sleeve for insertion into a recess in a housing or support part of a measurement movement, which sleeve is connectable in an electrically conductive manner to the movement, wherein the movement further comprises a circuit board to be secured to the housing or support part by the contact sleeve;

wherein said contact sleeve is operable with a contact to urge said sleeve outward for securing said sleeve in the recess by an insertion of the contact in said sleeve;

a portion of said contact sleeve is bent approximately radially outward on an end thereof facing said circuit board to form a flange-like widening which extends approximately radially outward and extends into a mouth region of the recess between said housing or support part and said circuit board;

upon said insertion of said contact into said sleeve, said circuit board is pressed by a clamping of said sleeve against said housing or support part at an end-side mouth region of the recess, there is a clamping of said flange-like widening between said housing or support part and said circuit board, and a conductive-track region of said circuit board is connected in electrically conductive manner to said contact sleeve;

said flange-like widening acts as a spring element, responsive to said insertion of said contact, to provide a spring loading to said flange-like widening during said clamping of said flange-like widening between said housing or support part and said circuit board for improved reliability of contact;

an outer wall of said contact sleeve is provided with means, activated by said insertion of said contact, for gripping a wall of said recess; and the flange-like widening comprises at least one radially outwardly directed tab.

28. A sleeve according to claim 27, wherein said gripping means is a knurling expanding outward upon said insertion of said contact.

29. A sleeve according to claim 27, wherein insertion of said contact includes a screwing of said contact.

* * * * *